US006494348B2

(12) United States Patent
Prestele

(10) Patent No.: US 6,494,348 B2
(45) Date of Patent: Dec. 17, 2002

(54) CARTRIDGE PISTON

(75) Inventor: Eugen Prestele, Augsburg (DE)

(73) Assignee: Sulzer Chemtech AG, Winterthur (CH)

( * ) Notice: Subject to any disclaimer, the term of this patent is extended or adjusted under 35 U.S.C. 154(b) by 0 days.

(21) Appl. No.: 09/937,809

(22) PCT Filed: Jan. 24, 2001

(86) PCT No.: PCT/EP01/00751

§ 371 (c)(1),
(2), (4) Date: Sep. 27, 2001

(87) PCT Pub. No.: WO01/55006

PCT Pub. Date: Aug. 2, 2001

(65) Prior Publication Data

US 2002/0153391 A1 Oct. 24, 2002

(30) Foreign Application Priority Data

Jan. 28, 2000 (DE) ..... 200 01 438 U

(51) Int. Cl.[7] ..... B65D 83/00
(52) U.S. Cl. ..... 222/326; 222/386
(58) Field of Search ..... 222/326, 327, 222/386

(56) References Cited

U.S. PATENT DOCUMENTS 2,886,215 A * 5/1959 Klein et al. ..... 222/326
3,501,063 A * 3/1970 Sundholm ..... 222/326
3,537,621 A * 11/1970 Jesse ..... 222/386
3,612,359 A * 10/1971 Sundholm ..... 222/309
4,077,493 A * 3/1978 Spaude et al. ..... 222/326
4,121,739 A * 10/1978 Devaney et al. ..... 222/386
4,452,370 A * 6/1984 Lagensiepen et al. ..... 222/327
6,039,215 A * 3/2000 Bell ..... 222/326
6,158,621 A * 12/2000 Keller ..... 222/327

FOREIGN PATENT DOCUMENTS

DE 295 06 800 8/1996

* cited by examiner

*Primary Examiner*—J. Casimer Jacyna
(74) *Attorney, Agent, or Firm*—Flynn, Thiel, Boutell & Tanis, P.C.

(57) ABSTRACT

The invention relates to a cartridge piston made of a material which is sensitive to the contents of the cartridge, comprising a covering disk which is made of a material which is not sensitive to the contents of the cartridge and arranged on the surface of the piston, having a structure which is adapted to one of the cross-sectional profiles of the surface of said piston. The area of the piston facing the wall of the cartridge is embodied as a V-shaped cross-sectional annular groove forming a sealing lip on the edge thereof. In order to protect the piston from the effects of the contents of the cartridge and to guarantee the sealing function of the piston even when the cartridge is curved, the outer diameter of the covering disk is smaller than the edge of the piston which forms the sealing lip and the edge of the covering disk is sealingly connected to the surface of the piston.

16 Claims, 4 Drawing Sheets

CARTRIDGE PISTON

FIELD OF THE INVENTION

The invention relates to a cartridge piston according to the preamble of claim 1.

BACKGROUND OF THE INVENTION

Cartridge pistons consist as a rule of a soft plastic, for example LDPE, in order to achieve the necessary sealing action toward the cartridge wall. However, such plastics are only resistant to a limited degree against certain materials forming the cartridge content, and are furthermore not sufficiently diffusion-tight. For example, the Plastic LDPE can be attacked by polyester resins that cause it to swell.

In order to avoid this, a covering disk, for example of polyamide, since polyamide is resistant against the aforementioned materials and is also diffusion tight, is arranged on the upper side of the piston. These covering disks can be flat or can be shaped corresponding to the cross-sectional shape of the piston surface. In both cases, such covering disks rest sealingly on the cartridge wall.

The known pistons have an annular groove which has a V-shaped cross section in the area facing the cartridge wall, the outer edge of which annular groove is designed as a sealing lip. When the cartridge content is pressed out of the cartridge due to pressure on the piston, then the cartridge swells. At the same time, the pressure applied to the cartridge content causes the outer leg of the V-shaped groove, and thus the sealing lip, to be pressed against the cartridge wall.

SUMMARY OF THE INVENTION

The above effect, however, does not occur when the piston surface is covered by a covering disk which seals off the cartridge toward the cartridge wall. When the cartridge swells due to the pressure applied to the cartridge content, the seal between the cartridge wall on the one side and the sealing lips of the covering disk and the piston on the other side is influenced so that cartridge content exits rearwardly past the piston.

The purpose is to design the cartridge in such a manner that on the one hand the piston is protected against the influence of the cartridge content and on the other hand the sealing function of the piston is guaranteed even when the cartridge swells.

The purpose is attained with the characteristics of claim 1. Advantageous developments are disclosed in the subclaims.

BRIEF DESCRIPTION OF THE DRAWINGS

Exemplary embodiments of the invention will be discussed in greater detail hereinafter in connection with the drawings, in which.

DETAILED DESCRIPTION

Figure 1:
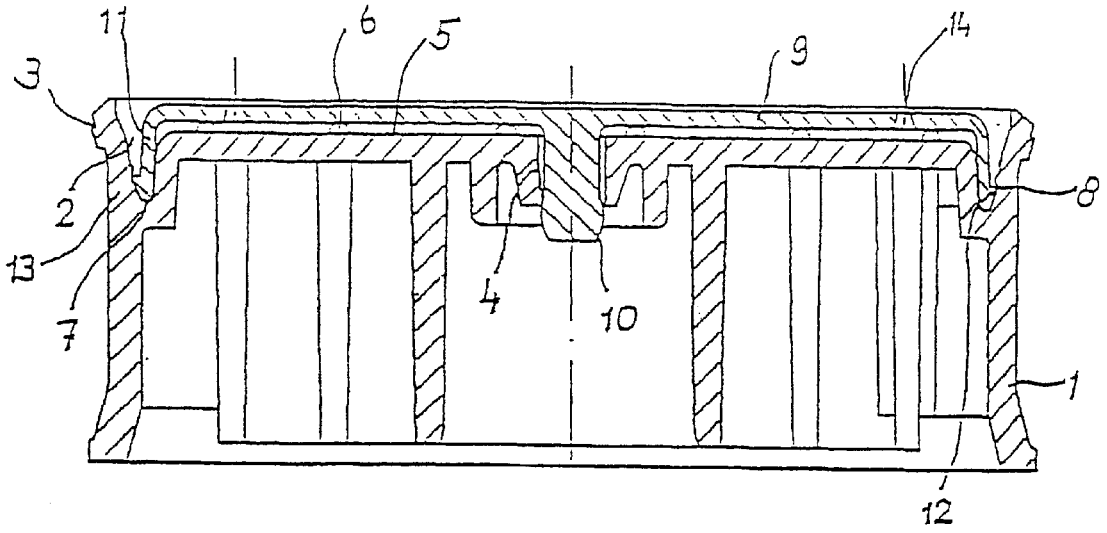
FIG. 1 is a cross-sectional view of a piston for a one-component cartridge.

The piston 1 according to FIG. 1 consists, for example, of polyethylene, preferably of LDPE. This piston 1 has an annular groove 2, which has a V-shaped cross section on the edge on its upper side. A flexible sealing lip 3 is provided at the end of the outer leg 13 of the groove 2. The piston has a locking bore 4 in its center. Spacing nubs 6 are formed on the piston surface 5. A circular locking projection 8 is formed on the inside in the area of the base of the groove 7 on the outwardly pointing leg 13 of the groove 2.

The covering disk 9 has a locking pin 10 in the center, which locking pin 10 engages the locking bore 4. Because of the spacing nubs 6 the covering disk 9 rests at a small distance from the piston surface 5. The outer edge of the covering disk 9 is angled L-shaped toward the base of the groove 7, whereby the angle 11 has a circular locking nose 12 at its lower end. The locking nose 12 is locked liquid-tight and gas-tight to the locking projection 8.

The outer leg 13 with the sealing lip 3 is indeed subjected to the cartridge content, however, this is not damaging since, due to the material utilized, only one enlargement can take place. The remaining areas of the piston 1 are by all means protected against the cartridge content. When the cartridge wall swells because of the pressure acting on the cartridge content, then the leg 13 swings simultaneously outwardly due to the pressure acting on the inside of the leg 13 so that the sealing lip 3 is pressed against the inside wall of the cartridge.

The covering disk 9 can have several bores 14. A vent channel can be provided between the locking pin 10 and the locking bore 4. For example, a vent channel is created when the locking bore has a cross section deviating from the circular shape.

Once pressure is exerted on the piston 1, the air in the cartridge can thus escape through the bores 14, the gap between the covering disk 9 and the piston surface 5 through the aforementioned vent channel.

Figure 2:
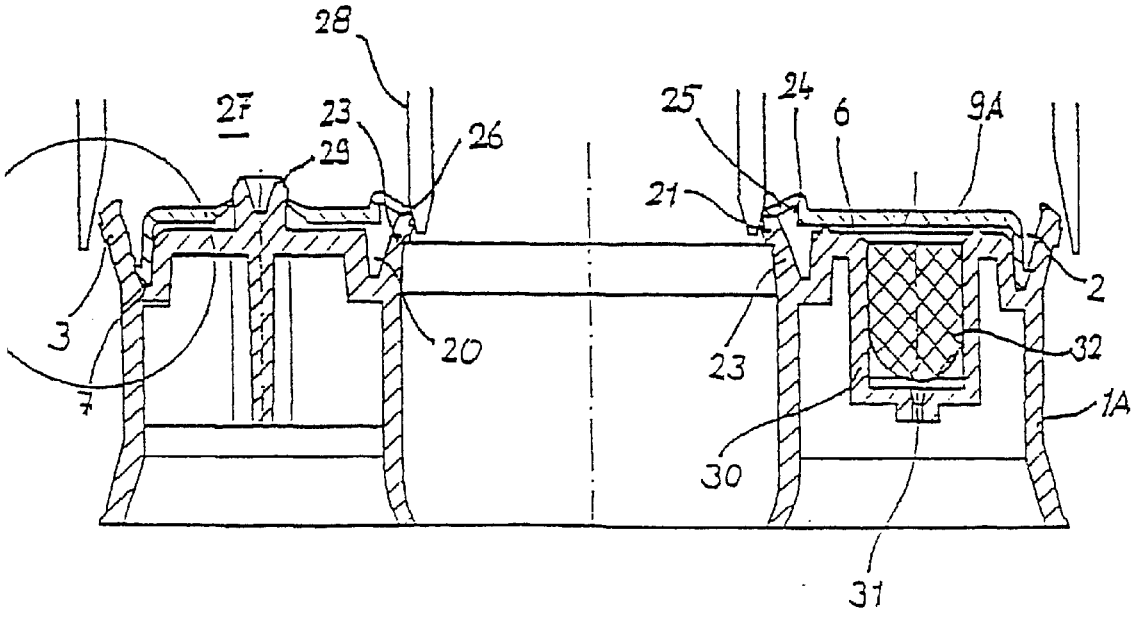
FIG. 2 is a cross-sectional view of an annular piston for a coaxial cartridge according to a first embodiment.

FIG. 2 illustrates an annular piston for a coaxial cartridge. The outer peripheral area 15 of the piston 1A is designed the same as described in connection with FIG. 1.

A circular V-shaped groove 20 is also provided in the inner area of the piston 1A, the inner leg 23 of which groove 20 has a sealing lip 21 at its end. The covering disk 9A has also a circular V-shaped groove 24 on its inner periphery, which groove 24, however, is arranged mirror-inverted with respect to the groove 20 of the piston 1A. The inner elastic leg 25 of the groove 24 terminates in a sealing lip 26, which comes to rest on the inner wall of the outer cartridge chamber 27.

This means that also, in the inner peripheral area, the parts of the piston 1A do not come into contact with the cartridge content, which is also desirable. It is also avoided that the leg 23 can swell and thus no longer sufficiently press against the inner wall of the chamber 27. On the other hand, it is notable that this inner wall 28 does not deform between the inner cartridge chamber and the outer annular cartridge chamber 27 when a pressure is applied on the cartridge content of said chambers.

In the FIG. 2 embodiment the piston has a locking pin 29, onto which is clipped the covering disk 22.

In order to vent, the piston has a pocket 30, which is open downwardly through a bore 31. A porous filter 32 is inserted into the pocket. The cartridge can thus be vented through the holes 14, the gap between the piston surface 5 and the covering disk 9A through the filter 32 and the bore 31.

Due to its inclined position, the inner elastic leg 25 thus eases the insertion of the piston 1A into the annular chamber 27.

Figure 3:
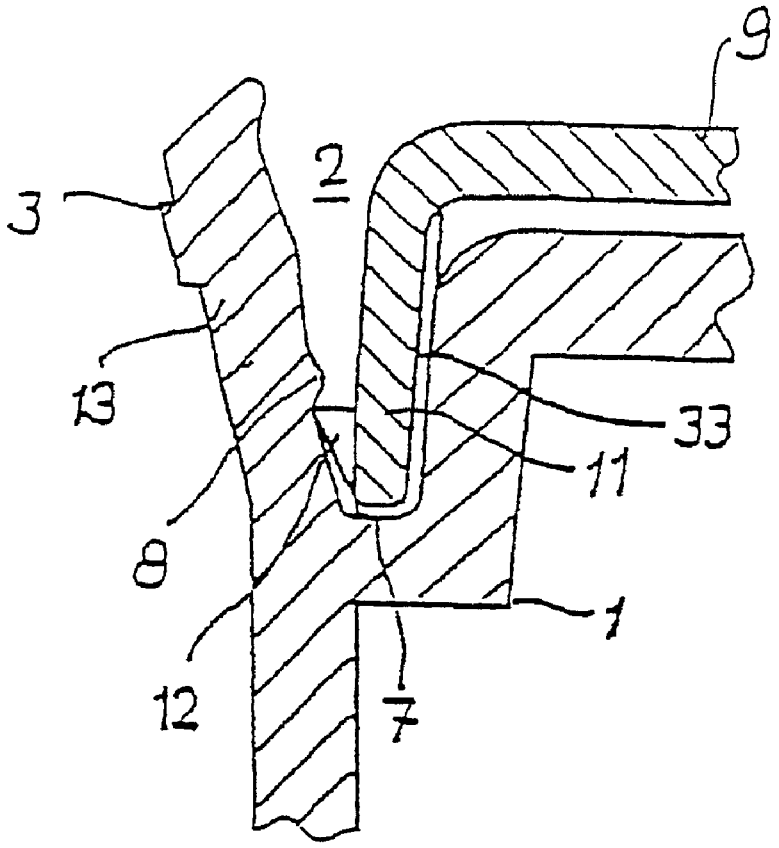
FIG. 3 is an edge-side cross-sectional view of the piston and the covering disk.

A further venting possibility, which replaces the bores 14, is illustrated in FIG. 3. The covering disk 9 has vertically extending vent channels 33 along the inner side of the angle 11, which extend over the lower edge of the angle and over the circular locking nose 12. The air escapes in this case through the channels 33, the gap between the piston surface 5 and the covering disk 9 or 9A and the vent channel or the filter.

Figure 4A:
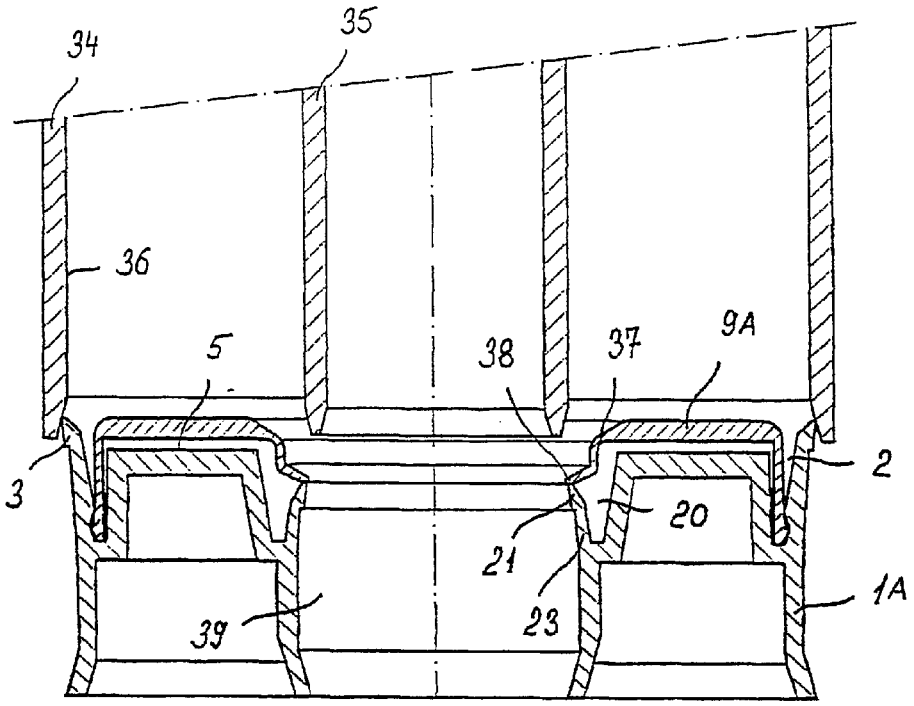
FIG. 4*a* is a cross-sectional view of an annular piston during introduction into a coaxial cartridge with a center inner pipe according to a second embodiment.
Figure 4B:
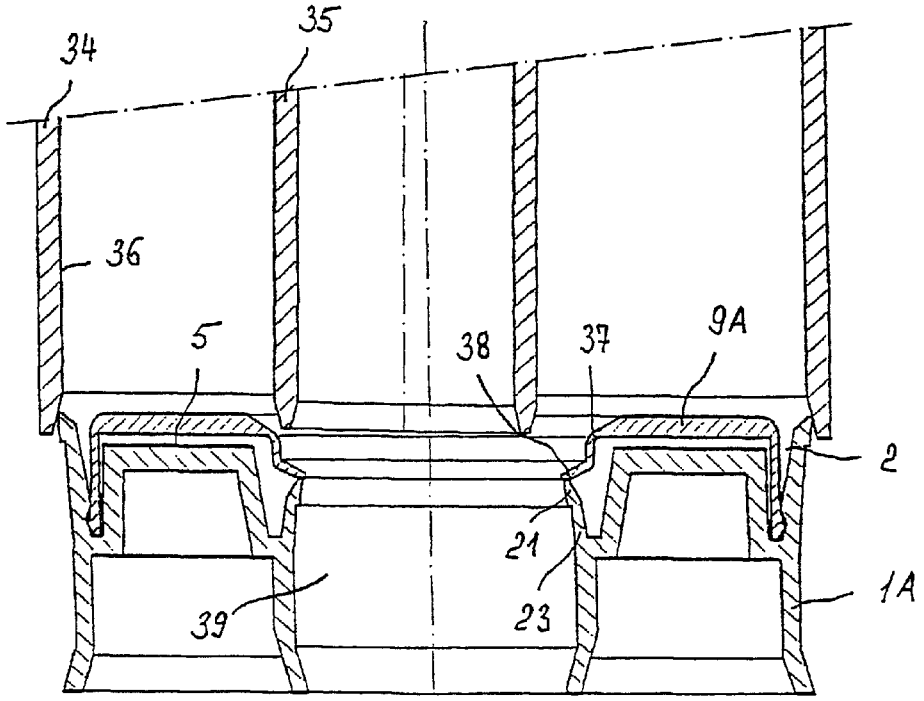
FIG. 4*b* is a cross-sectional view of the annular piston of FIG. 4*a* during introduction into a cartridge with an off-center inner pipe.

Also in the embodiment illustrated in FIGS. 4*a* and 4*b* of an annular piston 1A for a coaxial cartridge with an outer pipe 34 and an inner pipe 35, there is provided on the outer peripheral area of the piston 1A a V-shaped annular groove 2 and a radial outer flexible sealing lip 3 to rest on the inner wall 36 of the outer pipe 34. The L-shaped downwardly angled outer edge of a covering disk 9A is arranged in the annular groove 2 as in the embodiment of FIG. 2, and is held there by a suitable locking connection. A circular V-shaped groove 20 with a radially inner sealing lip 21 is also provided on an inner leg 23 on the inner peripheral area of the annular piston 1A. However, the inner sealing lip 21 in this embodiment is lower in axial direction some millimeters with respect to the outer sealing lip 3 so that, upon introduction of the annular piston 1A into the cartridge, initially the outer sealing lip 3 will rest on the inner wall 36 of the outer pipe 35 and the inner sealing lip 21 will not contact the inner pipe 35 until the annular piston 1A has been moved a few millimeters into the cartridge. This significantly reduces the forces needed for inserting the annular piston 1A into the cartridge compared to those embodiments where the piston simultaneously contacts the outer pipe and the inner pipe of the cartridge.

The covering disk 9A has on its inner periphery an area 37 extending inclined inwardly over the radial groove and resting on the inner leg 23, which area 37 ends in a circular sealing lip 38 on which the inner pipe 35 can rest. The inclined inner area 37 of the covering disk 1A forms an introduction inclination for the inner pipe 35. This has the advantage that the inner pipe 35 can be introduced without any problems even in the case of an inclined position illustrated in FIG. 4*b* into the center bore 39 of the annular piston 1A. Thus it is also possible to forego expensive precentering mechanisms, which are otherwise often needed in order to introduce the piston into the cartridge without any damage.

Figure 5A:
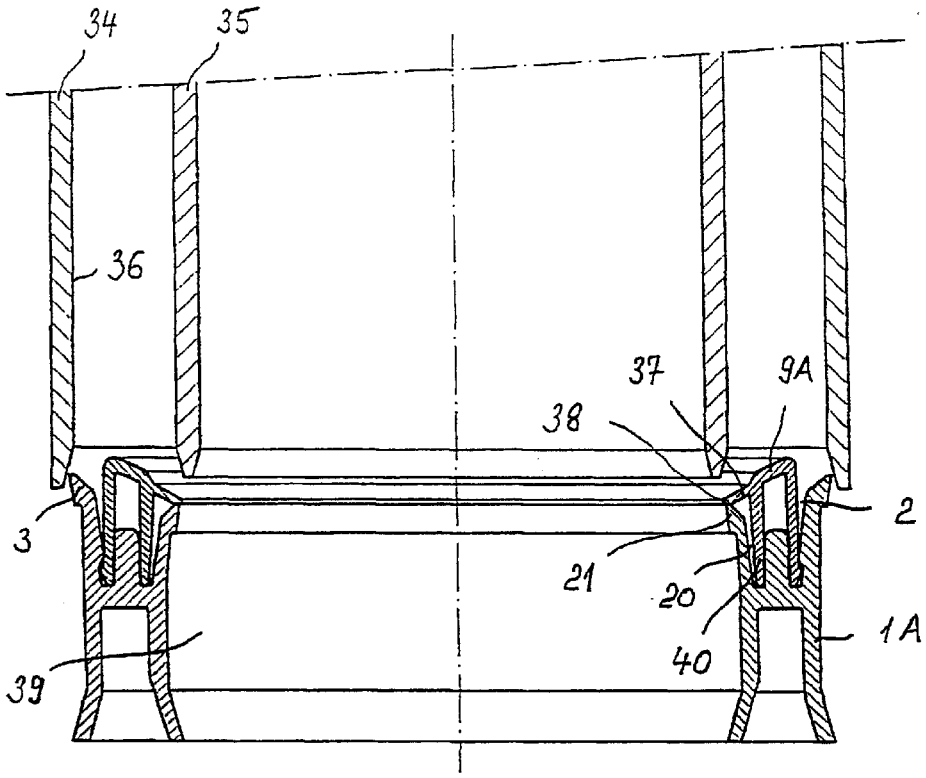
FIG. 5*a* is a cross-sectional view of an annular piston during introduction into a coaxial cartridge with a center inner pipe according to a third embodiment.
Figure 5B:
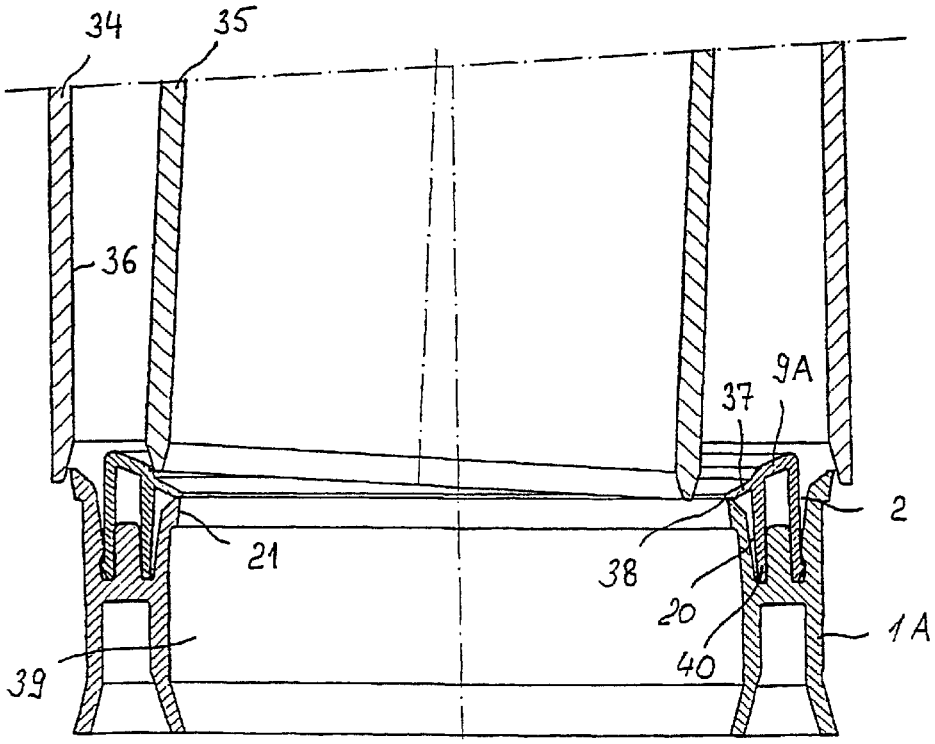
FIG. 5*b* is a cross-sectional view of the annular piston of FIG. 5*a* during the introduction into a coaxial cartridge with an off-center inner pipe.

In the embodiment illustrated in FIGS. 5*a* and 5*b*, the center bore 39 of the annular piston 1A has an inside diameter which is larger in comparison to the previous embodiment. This annular piston 1A is designed for a coaxial cartridge with a mixture ratio of 1:1, whereas the piston illustrated in FIGS. 4*a* and 4*b* is designed for a mixture ratio of 10:1. In the embodiment according to FIGS. 5*a* and 5*b* the inner area 37 of the covering disk 9A extends inclined inwardly and is used as the introduction inclination for the inner pipe 35. However, an additional circular web 40 is provided in this embodiment on the underside of the covering disk 9A, which web 40 projects into the radial inner groove 20 of the piston for a further support of the covering disk 9A.

What is claimed is:

1. A cartridge piston made of a material which is sensitive to contents of a cartridge, comprising a covering disk made of a material which is not sensitive to the contents of the cartridge, wherein said covering disk is arranged on a piston surface and has a structure adapted to a cross-sectional shape of the piston surface, whereby an area of the piston, which area faces a wall of the cartridge, is designed as an annular groove having a V-shaped cross section, the annular groove forming a sealing lip at its edge, wherein an outside diameter of the covering disk is smaller than the diameter at an edge of the piston forming the sealing lip and an edge of the covering disk is sealingly connected to the piston surface, wherein the covering disk is angled toward a base of the groove.

2. The cartridge piston according to claim 1, wherein a free end of the covering disk that is angled, is locked to the base of the groove.

3. The cartridge piston according to claim 1, wherein the covering disk and the piston are engaged with one another through at least one locking pin and one locking bore.

4. The cartridge piston according to claim 3, wherein the locking pin is arranged on the covering part and the locking bore is arranged on the piston, a vent channel is formed between the locking pin and the locking bore, and the covering disk includes at least one bore having a small diameter, wherein the bore communicates with the vent channel.

5. The cartridge piston according to claim 4, wherein spacing nubs are formed on the piston surface, the spacing nubs resting against the covering disk.

6. The cartridge piston according to claim 1, wherein the covering disk has at least one bore, a pocket opening toward a surrounding area is arranged on the piston, in the pocket is arranged a porous filter, and the bore communicates with the pocket.

7. The cartridge piston according to claim 1, wherein vent channels extend along an inside of a portion of the covering disk that is angled, over and beyond the lower edge of the portion of the disk that is angled, and over and beyond a locking nose.

8. The cartridge piston according to claim 1, wherein the piston is an annular piston for a coaxial cartridge, and the sealing lip comprises a radially outer sealing lip for abutting against an outer pipe of the coaxial cartridge and the piston includes a radially inner sealing lip for abutting against an inner pipe.

9. The cartridge piston according to claim 8, wherein the radially inner sealing lip is set back in axial direction with respect to the radially outer sealing lip.

10. The cartridge piston according to claim 8, wherein the covering disk is designed to seal and abut against the inner pipe of the coaxial cartridge.

11. The cartridge piston according to claim 8, wherein the area of the covering disk facing the inner pipe extends and inclines inwardly.

12. The cartridge piston according to claim 8, wherein the annular piston includes a circular V-shaped inner groove having an inner leg on an inner peripheral area, the leg being provided for the radially inner sealing lip.

13. The cartridge piston according to claim 12, wherein the covering disk includes a circular web on its underside that projects into the inner groove.

14. A combination of a cartridge piston and a covering disk for use with a cartridge, said cartridge piston comprising a material sensitive to contents of a cartridge and having a piston surface, a portion of said piston surface defining an annular groove at an outer edge of said cartridge piston, said piston including a sealing lip at the outer edge of said cartridge piston and defining an outer wall forming the annular groove, and said covering disk comprising a material that is not sensitive to the contents of the carriage, said covering disk being arranged on the piston surface and having a structure adapted to a cross-sectional shape of the piston surface, an outer diameter of said covering disk being less than the diameter of the sealing lip of said cartridge piston, an outer edge of said covering disk including an angled projection extending about the entirety of the disk and angled toward a base of the annular groove, wherein said angled projection secures the covering disk in the annular groove of said cartridge piston.

15. The combination of claim 14, wherein said sealing lip includes a circular locking projection at an inner surface thereof and said angled projection of said covering disk includes a circular locking nose projecting outwardly about the circumference thereof, wherein said locking projection receives said locking nose to lock said covering disk to said cartridge piston.

16. The combination of claim 14, wherein said cartridge piston comprises an annular piston for a coaxial cartridge and said sealing lip comprises an outer sealing lip for abutting against an outer pipe of a cartridge, said cartridge piston including a radial inner sealing lip for abutting against an inner pipe of a cartridge.

* * * * *